US011208224B2

(12) United States Patent
Chang

(10) Patent No.: US 11,208,224 B2
(45) Date of Patent: Dec. 28, 2021

(54) BAG CLAMPING DEVICE FOR MATERIAL BAG FILLING SYSTEM

(71) Applicant: Pao-Chung Chang, Taichung (TW)

(72) Inventor: Pao-Chung Chang, Taichung (TW)

(73) Assignee: Hon Buohb Co., Ltd., Taichung (TW)

( * ) Notice: Subject to any disclaimer, the term of this patent is extended or adjusted under 35 U.S.C. 154(b) by 38 days.

(21) Appl. No.: 16/891,064

(22) Filed: Jun. 3, 2020

(65) Prior Publication Data

US 2020/0290762 A1 Sep. 17, 2020

(30) Foreign Application Priority Data

Feb. 21, 2020 (TW) ..... 109105574

(51) Int. Cl.

| | |
|---|---|
| ***B65B 43/46*** | (2006.01) |
| ***B65B 1/04*** | (2006.01) |
| ***B65B 39/04*** | (2006.01) |
| ***B65B 43/16*** | (2006.01) |
| ***B65B 43/44*** | (2006.01) |
| ***B65B 51/10*** | (2006.01) |

(52) U.S. Cl.

CPC ..... *B65B 43/465* (2013.01); *B65B 1/04* (2013.01); *B65B 39/04* (2013.01); *B65B 43/16* (2013.01); *B65B 43/44* (2013.01); *B65B 51/10* (2013.01)

(58) Field of Classification Search

CPC ..... B65B 43/465

See application file for complete search history.

(56) References Cited

U.S. PATENT DOCUMENTS

| | | | | |
|---|---|---|---|---|
| 5,275,527 | A * | 1/1994 | Turra | B65B 43/185 414/792 |
| 5,340,263 | A * | 8/1994 | Neri | B65B 43/185 414/412 |
| 5,673,541 | A * | 10/1997 | Arzuman | B65B 43/465 53/284.7 |
| 6,662,532 | B1 * | 12/2003 | Droog | B65B 43/36 53/373.6 |
| 2004/0088953 | A1 * | 5/2004 | Wilson, Jr. | B65B 43/36 53/573 |
| 2009/0241487 | A1 * | 10/2009 | Actis | B65B 7/08 53/563 |
| 2009/0272074 | A1 * | 11/2009 | Kurz | B65B 59/003 53/284.7 |
| 2009/0320958 | A1 * | 12/2009 | Matheyka | B65B 25/005 141/98 |
| 2010/0037561 | A1 * | 2/2010 | Matheyka | B65B 43/465 53/459 |

* cited by examiner

*Primary Examiner* — Hemant Desai
*Assistant Examiner* — Tanzim Imam

(57) ABSTRACT

A bag clamping device for a material bag filling system is provided. A filling tube portion of a material bag can be blown to be in an upright state from a collapsed state through displacement and lift of an X-axis rail, a Y-axis rail and a Z-axis rail and blow of a pair of blowers. A pair of electric clamps is configured to clamp the filling tube portion. A pair of cantilevers is displaced to the bottom of a material filling device. The filling tube of the material filling device is displaced in a Z direction to enter the material bag for blowing air and filling the material. Through a conveyor belt displaced at the bottom in an X direction to carry the material bag with the filled material to a sealing device for sealing, so as to complete the packaging.

10 Claims, 11 Drawing Sheets

BAG CLAMPING DEVICE FOR MATERIAL BAG FILLING SYSTEM

FIELD OF THE INVENTION

The invention relates to a bag clamping device, and more particularly to a bag clamping device for a material bag filling system.

BACKGROUND OF THE INVENTION

A conventional material bag filling system comprises at least one material bag. The filling and packaging of the material bag are completed through a bag clamping device, a material filling device and a sealing device. The upper end of the material bag is provided with a filling tube portion. The bag clamping device is configured to clamp the filling tube portion of the material bag, and then the material bag is conveyed to be under the bottom of a filling tube of the material filling device. The filling tube is inserted into the material bag for inflation and filling, and then the material bag is sealed by the sealing device.

However, for the conventional bag clamping device, the material bag is placed on a clamp manually, which is time-consuming and labor-consuming to increase the cost.

In addition, the opening of the material bag can be opened by vacuum suction through the design of an automatic gripper, and then the clamp of the bag clamping device clamps the material bag. It is not easy to control the vacuum suction of the automatic gripper, and the material bag may fall. The positioning of the gripper is unstable, and the failure rate is very high, so its reliability is low. Accordingly, the inventor of the invention has devoted himself based on his many years of practical experiences to solve these problems.

SUMMARY OF THE INVENTION

The primary object of the invention is to provide a bag clamping device for a material bag filling system, comprising at least one material bag. An upper end of the material bag is provided with a filling tube portion. Filling and packaging of the material bag are completed by the bag clamping device, a material filling device and a sealing device. A direction extending along a length of the material bag is defined as an X direction. A direction extending along a width of the material bag is defined as a Y direction. A direction extending along a height of the material bag is defined as a Z direction.

The bag clamping device includes at least one pair of X-axis rails disposed on a wall and parallel to the X direction, at least one Z-axis rail slidable along the pair of X-axis rails, a Y-axis rail slidable along the Z-axis rail, a pair of cantilevers slidable along the Y-axis rail, a pair of electric clamps disposed on the pair of cantilevers, and a pair of blowers disposed on respective ends of the pair of electric clamps.

With the above structure, the filling tube portion of the material bag can be blown to be in an upright state from a collapsed state through the displacement and lift of the X-axis rails and the Z-axis rail and the blow of the blowers. The pair of electric clamps is configured to clamp the filling tube portion to provide a stable clamping effect, thereby achieving the benefits of labor saving or stable clamping. Next, the pair of cantilevers is displaced to the bottom of the material filling device. The filling tube of the material filling device is displaced in the Z direction to enter the material bag from the filling tube portion of the material bag for blowing air and filling the material. Then, through a conveyor belt displaced at the bottom in the X direction to carry the material bag with the filled material to the sealing device for sealing, so as to complete the packaging.

Preferably, the electric clamp includes a movable plate which is actuated and pressed by a power source and a downward-pressing plate opposite to the movable plate. The power source is arranged on the top of the electric clamp. The movable plate is an L-shaped plate and is pivotally connected to the inside of the electric clamp. The downward-pressing plate is disposed at one side of the electric clamp, and has at least one protruding portion relative to one side of the filling tube portion of the material bag. Through the action of the power source, the L-shaped movable plate is pressed down, corresponding to the protruding portion of the downward-pressing plate, so as to tightly clamp the filling tube portion of the material bag.

Preferably, the Y-axis rail is provided with a Y-axis bidirectional screw rod that is actuated by a Y-axis motor; the pair of X-axis rails drives X-axis screw rods through at least one X-axis motor to displace the Z-axis rail; and the at least one Z-axis rail drives a Z-axis screw rod through at least one Z-axis motor to displace the Y-axis rail. Through the rotation of the X-axis screw rod, the Z-axis screw rod and the Y-axis motor to control the Y-axis bidirectional screw rod, the pair of cantilevers is operated to move back and forth in the Y direction, so as to achieve precise distance control.

Preferably, a timing belt is provided between the pair of X-axis rails to synchronize the two X-axis screw rods, thereby avoiding the misalignment of the two opposing screw rods.

Preferably, the at least one material bag is stacked on a pallet, so that the pallet and the at least one material bag can be transported through a transport vehicle.

Preferably, the material filling device includes a C-shaped clasp for clasping the filling tube portion of the material bag. When the C-shaped clasp clasps the filling tube portion of the material bag, the pair of electric clamps can be moved away from the material bag in the X direction. When the filling tube of the material filling device starts to fill the material, the material bag is stably positioned.

Preferably, the material filling device is connected with a gas pipe, so that the material bag can be inflated before the filling tube of the material filling device starts to fill the material. It is beneficial for the filling tube to fill the material.

Preferably, the sealing device is a heat sealer for sealing the filling tube portion of the material bag. The filling tube portion of the material bag is tightly sealed by the heat sealer.

Embodiments of the invention will now be described, by way of example only, with reference to the accompanying drawings.

DETAILED DESCRIPTION OF THE PREFERRED EMBODIMENTS

Figure 1:
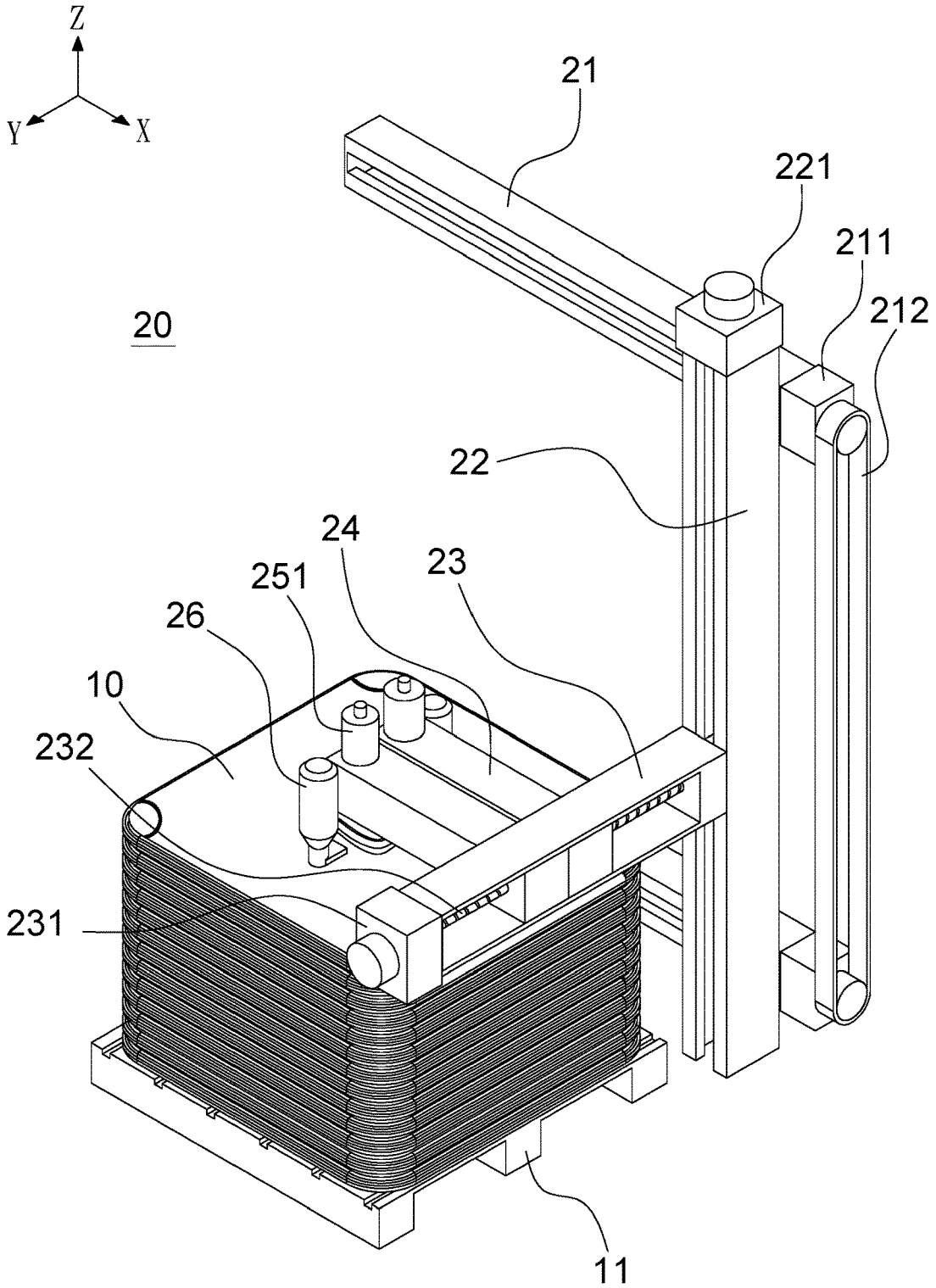
FIG. 1 is a perspective view of the invention, illustrating a first action.
Figure 2:
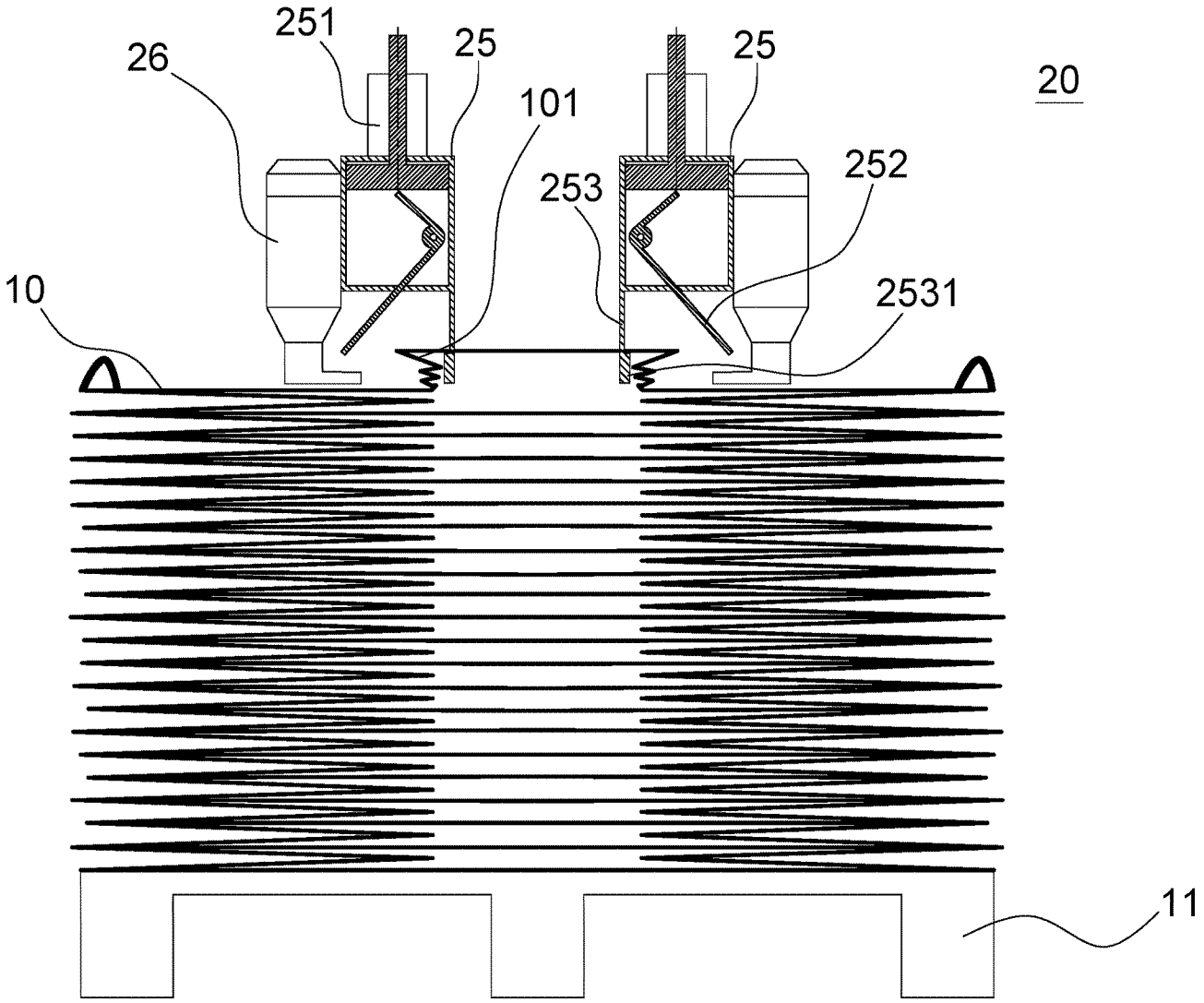
FIG. 2 is a front view of operating the material bag of the invention, illustrating a second action.
Figure 3:
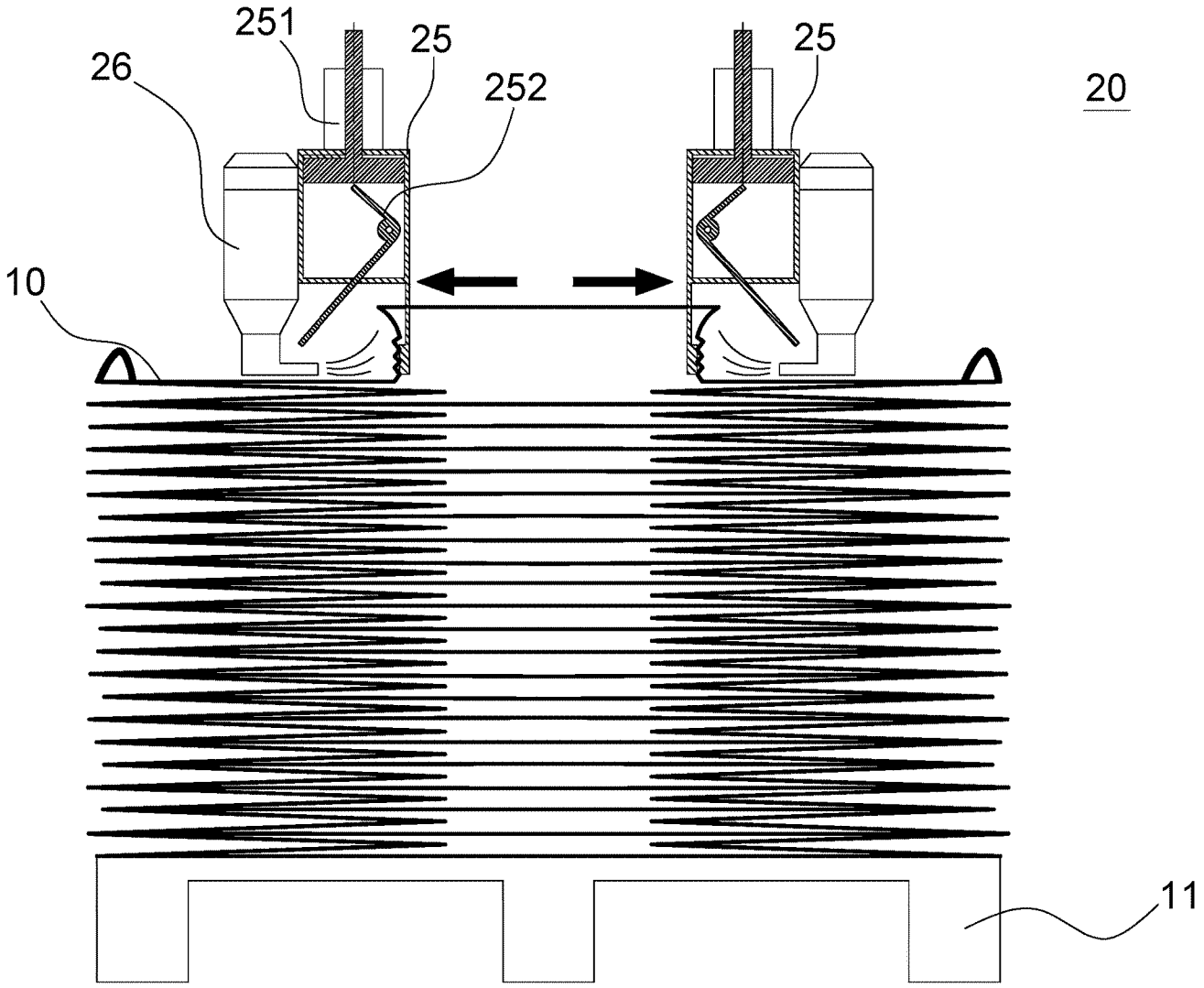
FIG. 3 is a front view of operating the material bag of the invention, illustrating a third action.
Figure 4:
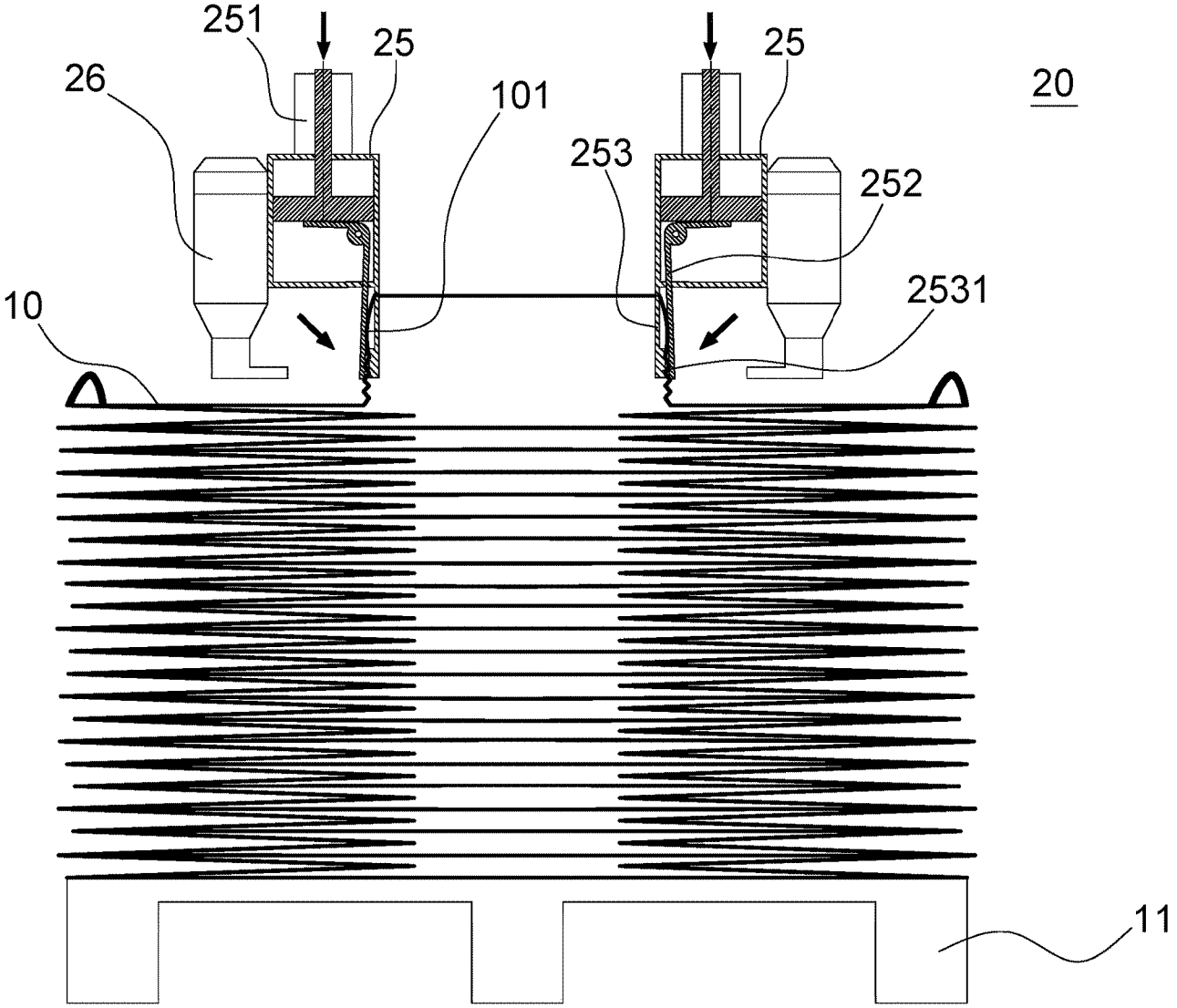
FIG. 4 is a front view of operating the material bag of the invention, illustrating a fourth action.
Figure 5:
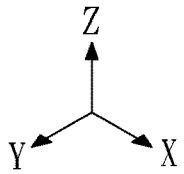
FIG. 5 is a perspective view of the invention, illustrating a fifth action.
Figure 5:
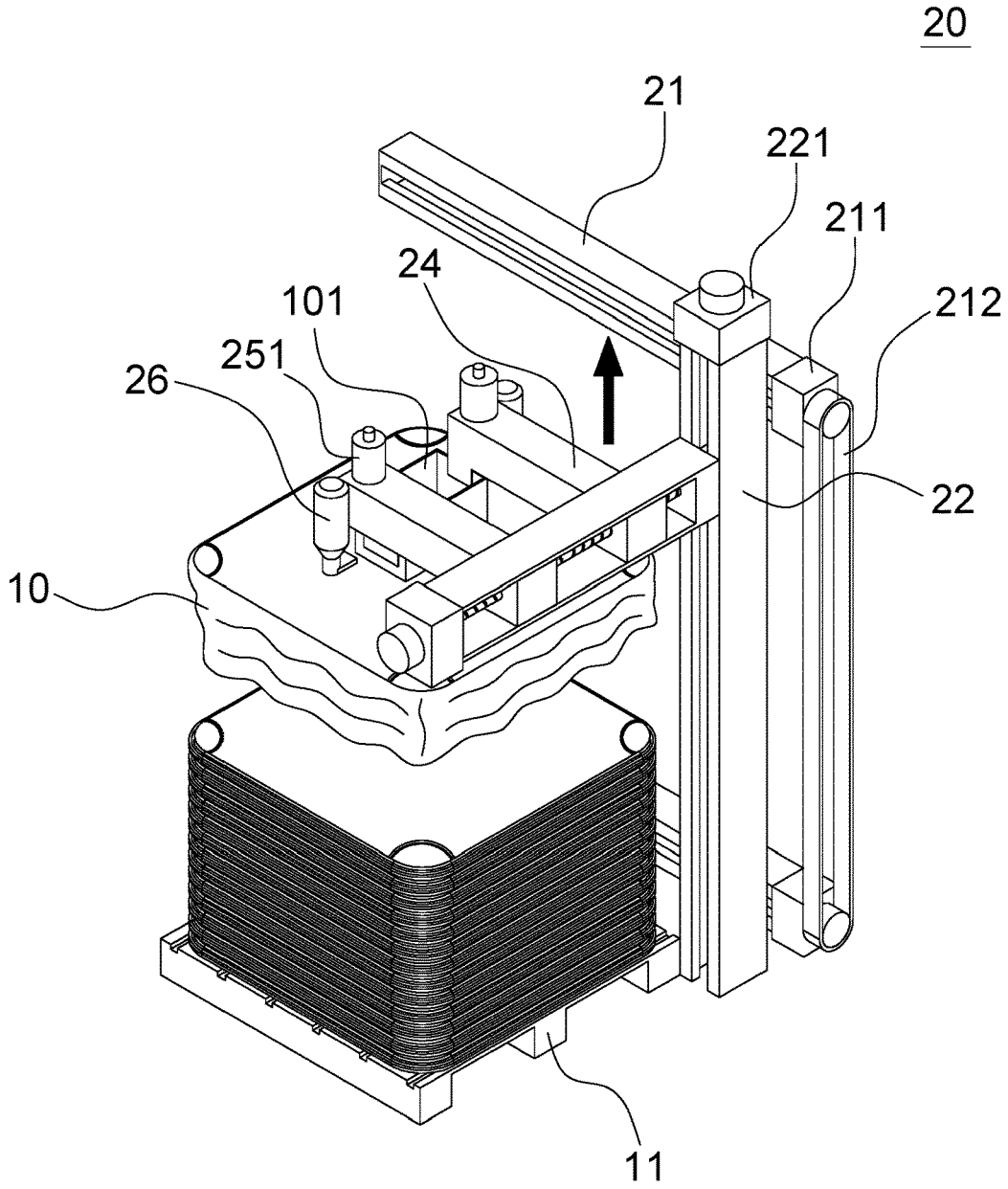

Referring to FIGS. 1-4, the invention provides a bag clamping device for a material bag filling system, comprising a plurality of material bags 10. A filling tube portion 101 is provided on the upper end of each of the plurality of material bags. Filling and packaging of the material bags 10 are completed by a bag clamping device 20, a material filling device 30 and a sealing device 40 that are automatically controlled. A direction extending along the length of the material bag 10 is defined as an X direction. A direction extending along the width of the material bag 10 is defined as a Y direction. A direction extending along the height of the material bag 10 is defined as a Z direction.

The bag clamping device 20 includes at least one pair of X-axis rails 21 disposed on the wall and parallel to the X direction, at least one Z-axis rail 22 slidable along the pair of X-axis rails 21, a Y-axis rail 23 slidable along the Z-axis rail 22, a pair of cantilevers 24 slidable along the Y-axis rail 23, a pair of electric clamps 25 disposed on the pair of cantilevers 24 (the electric clamps 25 are opened and closed by electric control), and a pair of blowers 26 disposed on respective ends of the pair of electric clamps 25 (the blower 26 may be provided with an extension head).

Figure 6:
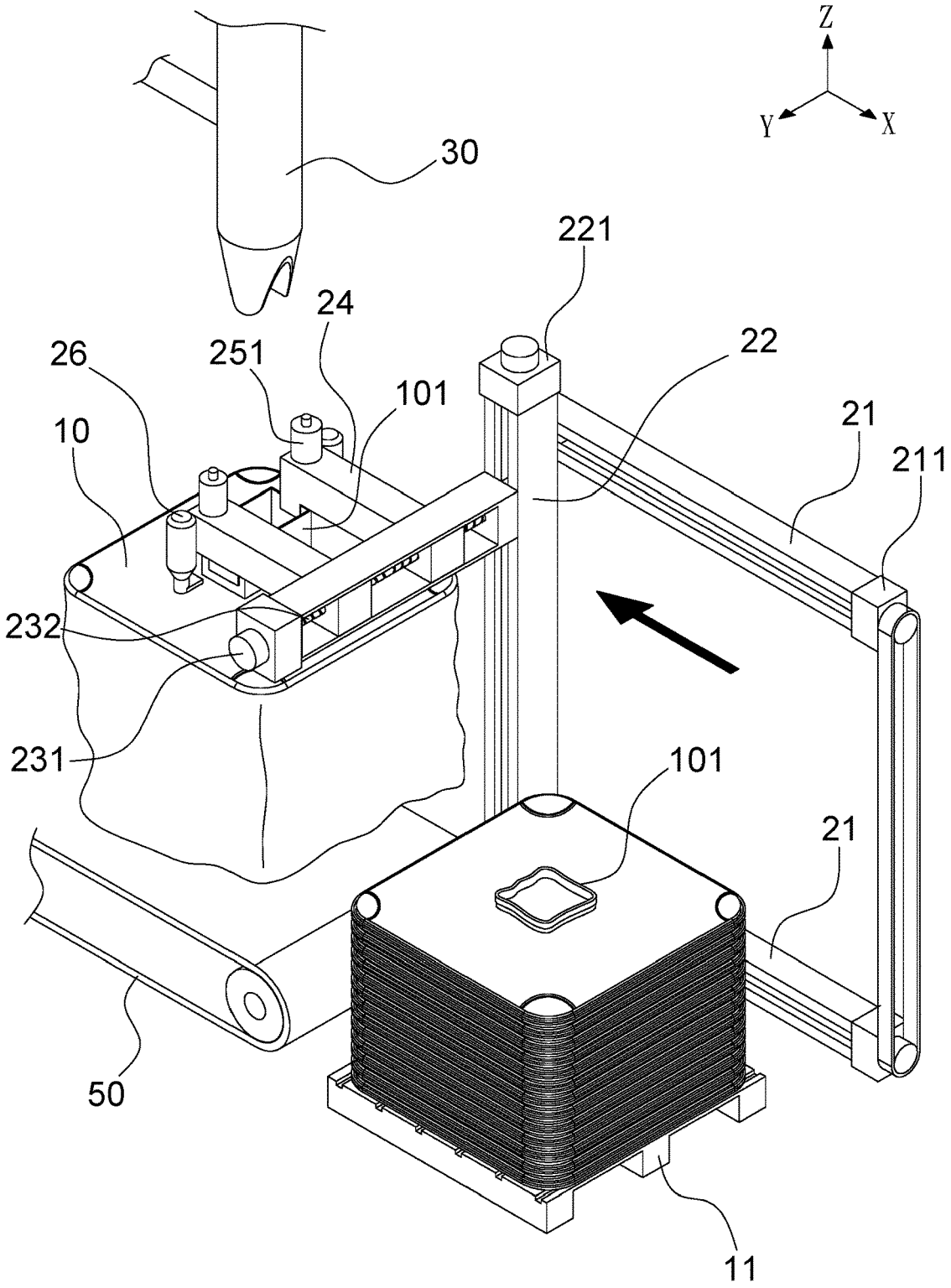
FIG. 6 is a perspective view of the invention, illustrating a sixth action.

With the above structure, the filling tube portion 101 of the material bag 10 can be blown to be in an upright state from a collapsed state through the displacement and lift of the X-axis rails 21 and the Z-axis rail 22 and the blow of the blowers 26. The pair of electric clamps 25 is configured to clamp the filling tube portion 101 to provide a stable clamping effect, thereby achieving the benefits of labor saving or stable clamping. Next, the pair of cantilevers 24 is displaced to the bottom of the material filling device 30 (see FIG. 6). The filling tube of the material filling device 30 is displaced in the Z direction to enter the material bag 10 from the filling tube portion 101 of the material bag 10 for blowing air and filling the material. Then, through a conveyor belt 50 (see FIG. 11) displaced at the bottom in the X direction to carry the material bag 10 with the filled material to the sealing device 40 for sealing (see FIG. 10), so as to complete the packaging.

The electric clamp 25 includes a movable plate 252 which is actuated and pressed by a power source 251 (a pneumatic cylinder, a hydraulic cylinder or a motor), and a downward-pressing plate 253 opposite to the movable plate 252. The power source 251 is arranged on the top of the electric clamp 25. The movable plate 252 is an L-shaped plate and is pivotally connected to the inside of the electric clamp 25. The downward-pressing plate 253 is disposed at one side of the electric clamp 25. The downward-pressing plate 253 has at least one protruding portion 2531 relative to one side of the filling tube portion 101 of the material bag 10 for increasing frictional force. Through the action of the power source 251, the L-shaped movable plate 252 is pressed down, corresponding to the protruding portion 2531 of the downward-pressing plate 253, so as to tightly clamp the filling tube portion 101 of the material bag 10.

Please refer to FIG. 2 through FIG. 5. The Y-axis rail 23 is provided with a Y-axis bidirectional screw rod 232 that is actuated by a Y-axis motor 231; the pair of X-axis rails 21 drives X-axis screw rods through at least one X-axis motor 211 to displace the Z-axis rail 221; the at least one Z-axis rail 22 drives a Z-axis screw rod through at least one Z-axis motor 221 to displace the Y-axis rail 23. Through the rotation of the X-axis screw rod, the Z-axis screw rod and the Y-axis motor 231 to control the Y-axis bidirectional screw rod 232, the pair of cantilevers 24 is operated to move back and forth in the Y direction, so as to achieve precise distance control.

Preferably, as shown in FIGS. 5 to 8, a timing belt 212 is provided between the pair of X-axis rails 21 to synchronize the two X-axis screw rods, thereby avoiding the misalignment of the two opposing screw rods. In another implementation, the screw rods of the pair of X-axis rails 21 are controlled to rotate synchronously through a computer (not shown).

In the implementation of the invention, the plurality of material bags 10 are stacked on a pallet 11, so that the pallet 11 and the plurality of material bags 10 can be transported through a transport vehicle (forklift).

Figure 7:
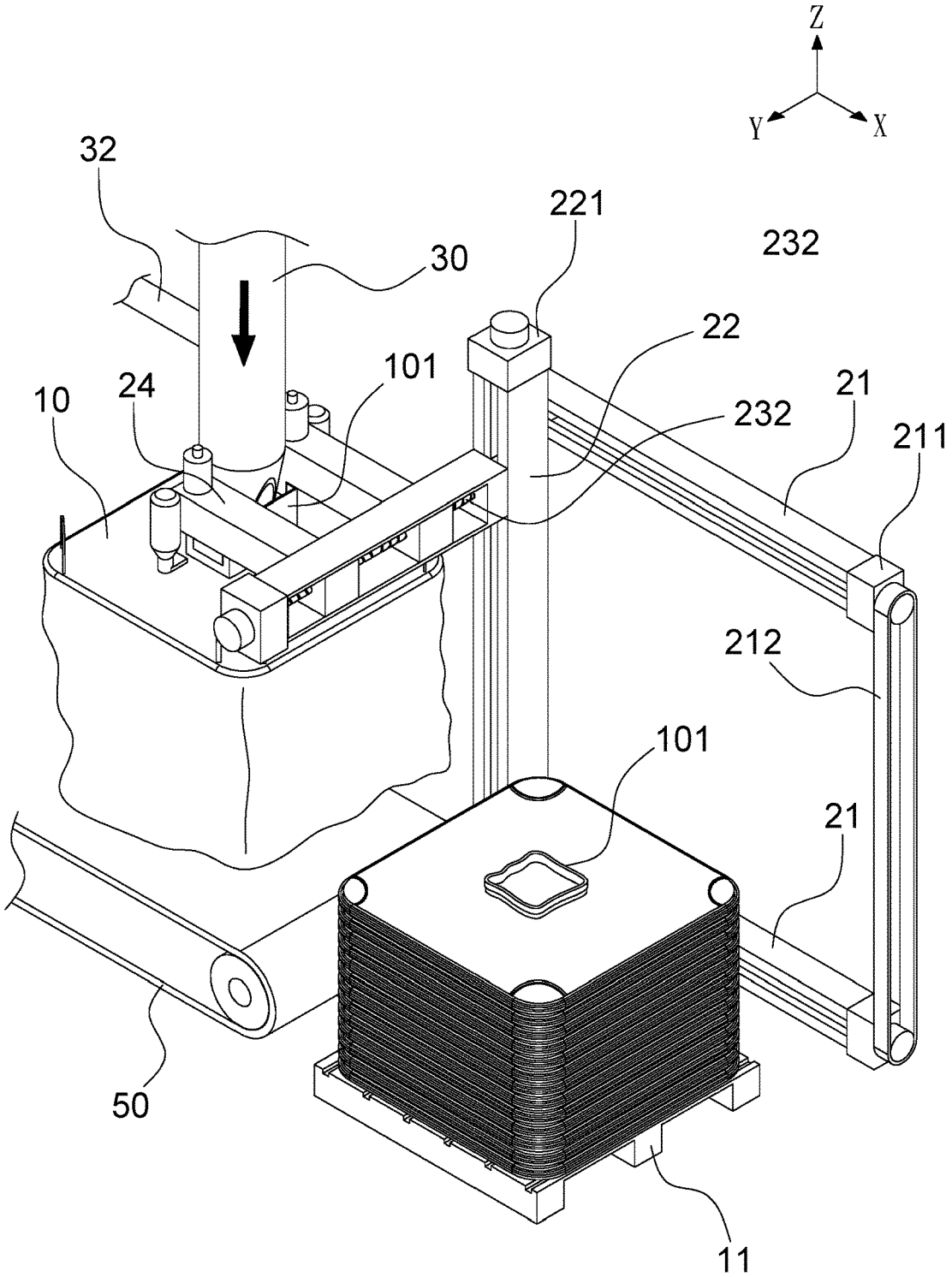
FIG. 7 is a perspective view of the invention, illustrating a seventh action.
Figure 8:
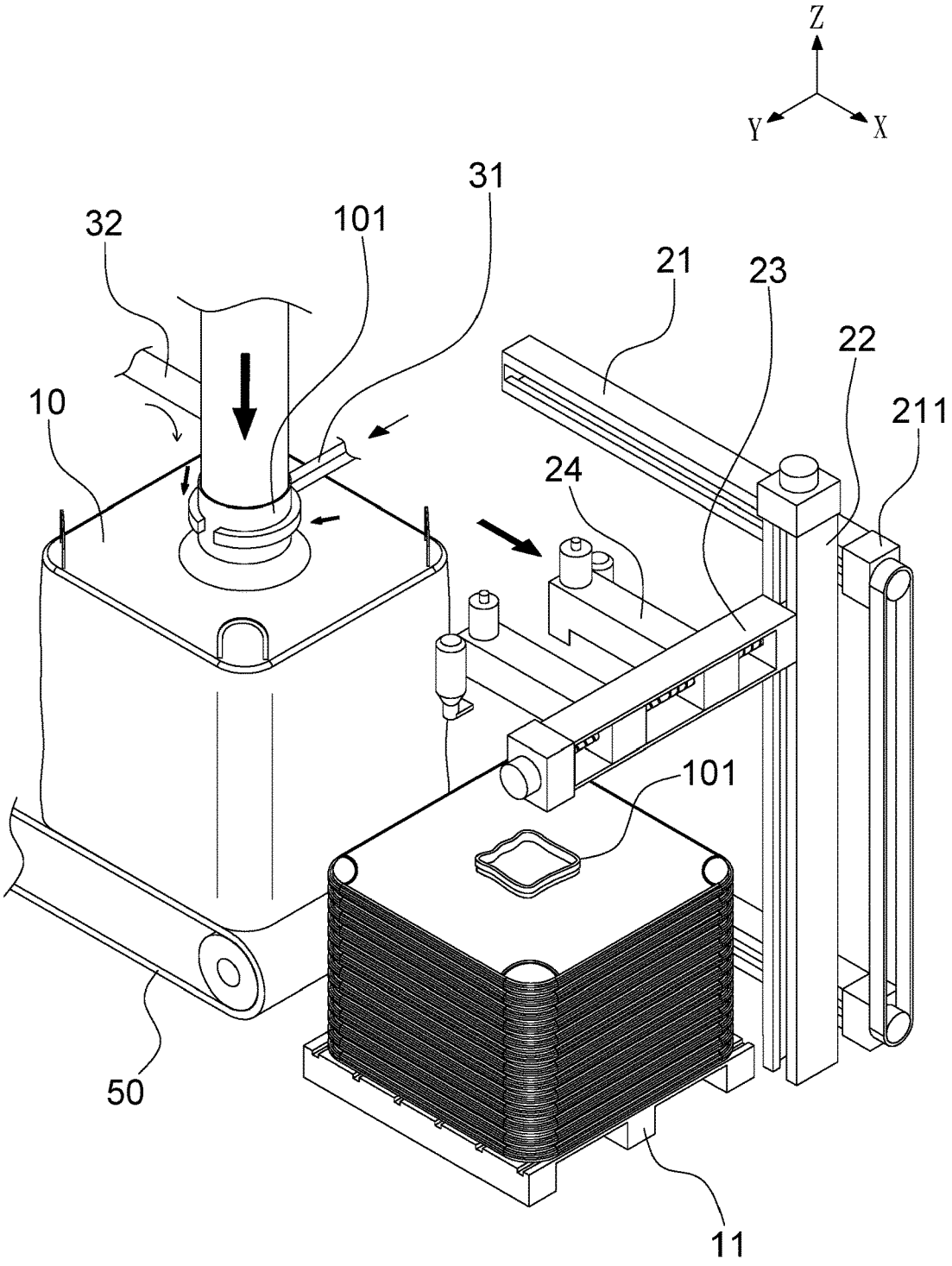
FIG. 8 is a perspective view of the invention, illustrating an eighth action.
Figure 9:
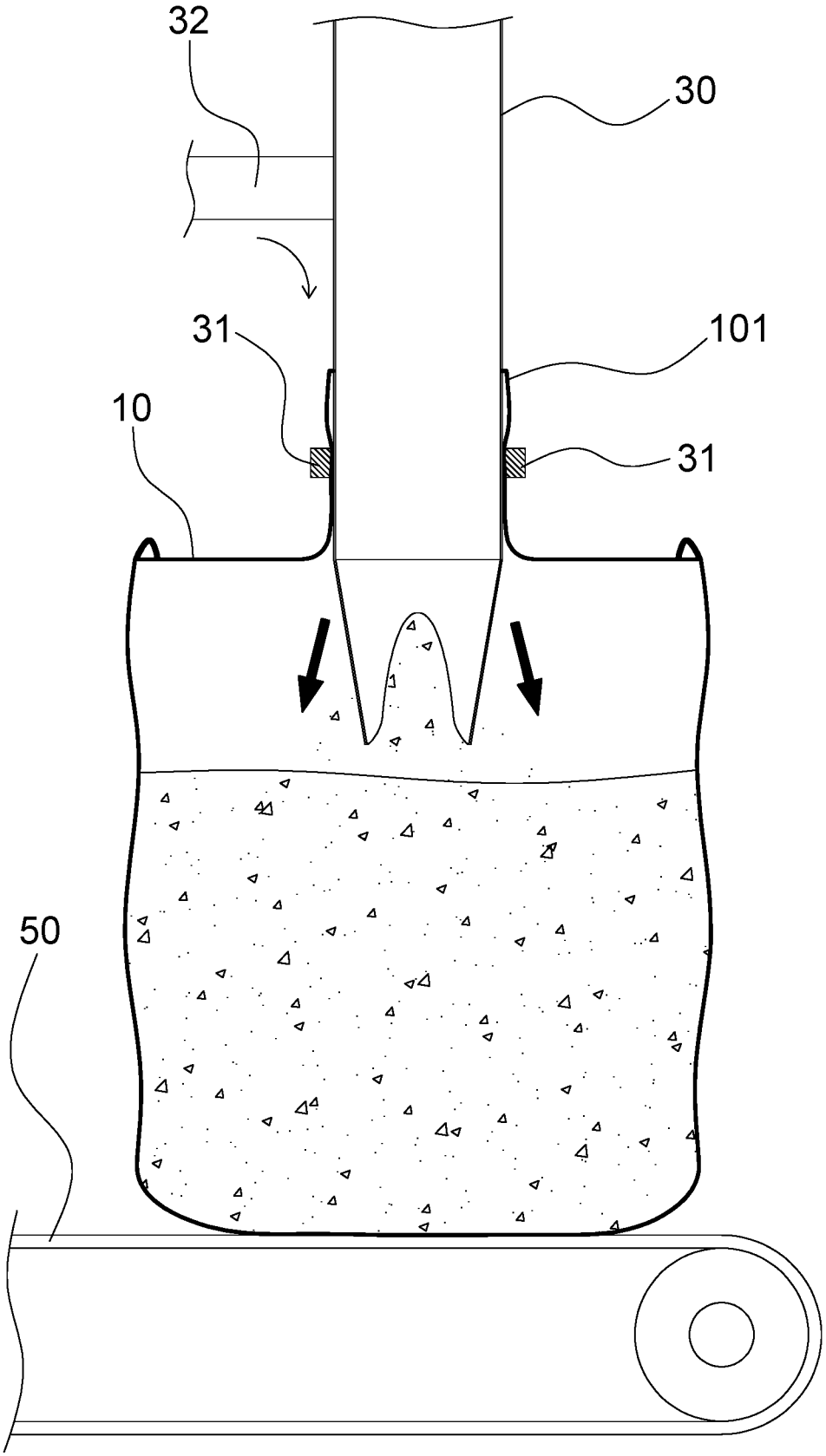
FIG. 9 is a front view of filling the material, illustrating a ninth action.

Please refer to FIG. 9 in conjunction with FIG. 7 and FIG. 8. In detail, the material filling device 30 includes a C-shaped clasp 31 for clasping the filling tube portion 101 of the material bag 10. When the C-shaped clasp 31 clasps the filling tube portion 101 of the material bag 10, the pair of electric clamps 25 can be moved away from the material bag 10 in the X direction. When the filling tube of the material filling device 30 starts to fill the material, the material bag 10 is stably positioned.

In addition, referring to FIG. 8 and FIG. 9, the material filling device 30 is connected with a gas pipe 32, so that the material bag 10 can be inflated before the filling tube of the material filling device 30 starts to fill the material. It is beneficial for the filling tube to fill the material.

Figure 10:
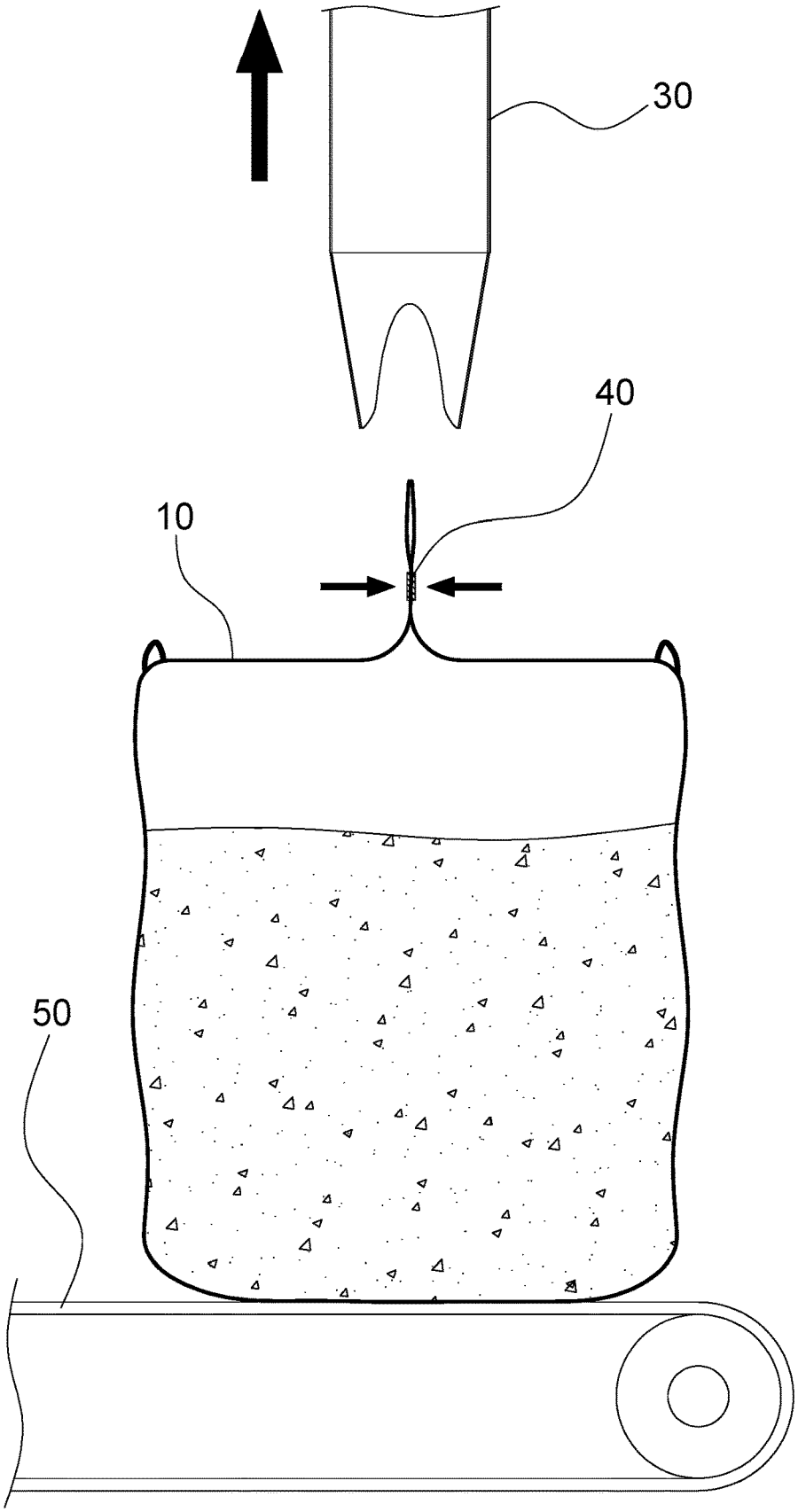
FIG. 10 is a front view of sealing the material bag, illustrating a tenth action.
Figure 11:
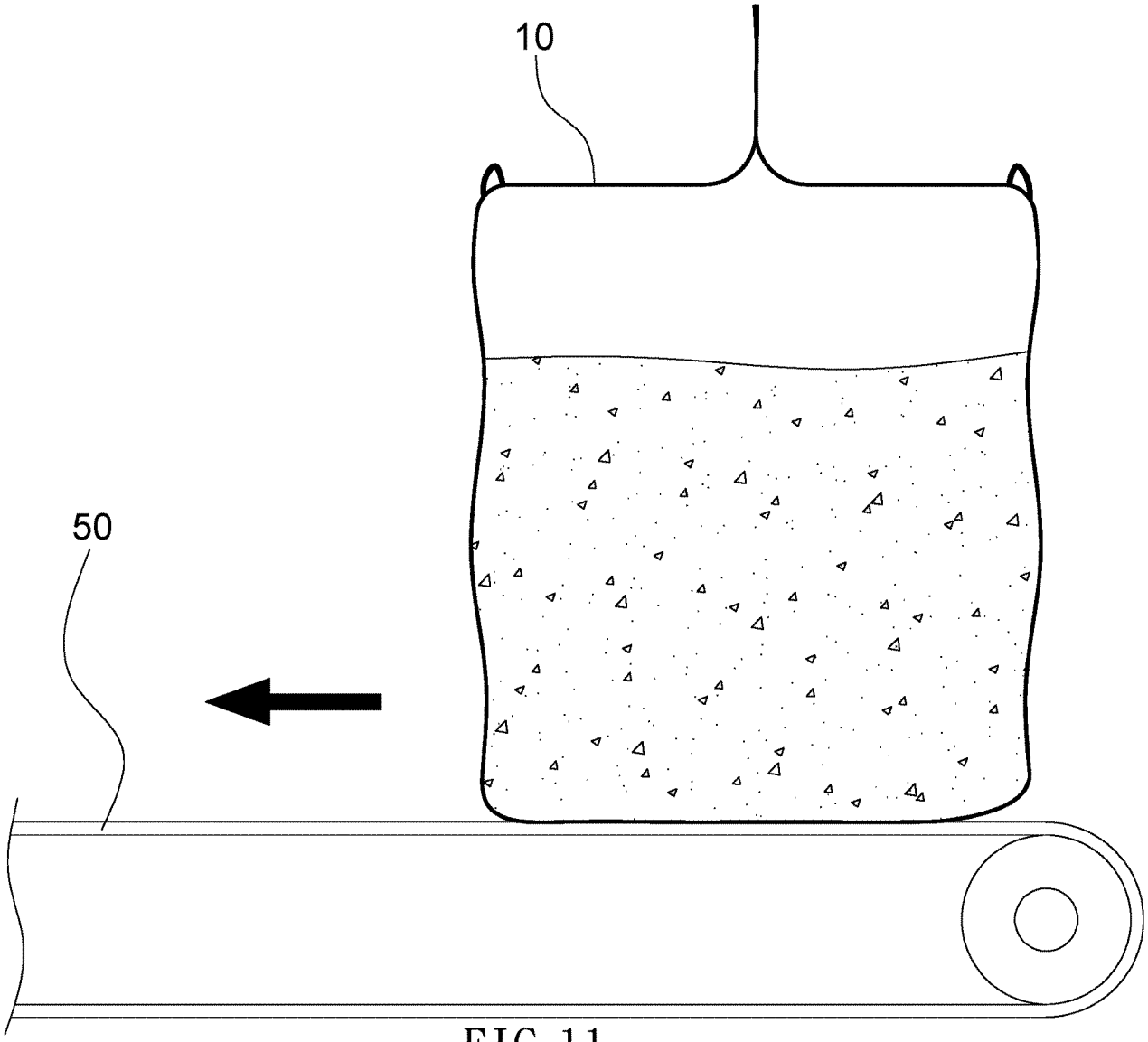
FIG. 11 is a front view of carrying the material bag, illustrating an eleventh action.

Finally, as shown in FIG. 10, the sealing device 40 is a heat sealer (which may be a V-shaped sealer) for sealing the filling tube portion 101 of the material bag 10. The filling tube portion 101 of the material bag 10 is tightly sealed by the heat sealer.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A bag clamping device for a material bag filling system, comprising at least one material bag, an upper end of the at least one material bag being provided with a filling tube portion, filling and packaging of the at least one material bag being completed by the bag clamping device, a material filling device and a sealing device, a direction extending along a length of the at least one material bag being defined as an X direction, a direction extending along a width of the at least one material bag being defined as a Y direction, and a direction extending along a height of the at least one material bag being defined as a Z direction;

the bag clamping device including at least one pair of X-axis rails disposed on a wall and parallel to the X direction, at least one Z-axis rail slidable along the at least one pair of X-axis rails, a Y-axis rail slidable along the at least one Z-axis rail, a pair of cantilevers slidable along the Y-axis rail, a pair of electric clamps disposed on the pair of cantilevers, and a pair of blowers disposed on respective ends of the pair of electric clamps.

2. The bag clamping device as claimed in claim 1, wherein each electric clamp includes a movable plate that is actuated and pressed by a power source and a downward-pressing plate opposite to the movable plate; the power source is arranged on a top of each electric clamp; and the movable plate is an L-shaped plate and is pivotally connected to an inside of each electric clamp.

3. The bag clamping device as claimed in claim 2, wherein the power source is a pneumatic cylinder, a hydraulic cylinder or a motor.

4. The bag clamping device as claimed in claim 2, wherein the downward-pressing plate is disposed at one side of each electric clamp and has at least one protruding portion relative to one side of the filling tube portion of the at least one material bag.

5. The bag clamping device as claimed in claim 1, wherein the Y-axis rail is provided with a Y-axis bidirectional screw rod that is actuated by a Y-axis motor; the at least one pair of X-axis rails drives X-axis screw rods through at least one X-axis motor to displace the at least one Z-axis rail; and the at least one Z-axis rail drives a Z-axis screw rod through at least one Z-axis motor to displace the Y-axis rail.

6. The bag clamping device as claimed in claim 5, wherein a timing belt is provided between the at least one pair of X-axis rails to synchronize the two X-axis screw rods.

7. The bag clamping device as claimed in claim 1, wherein the at least one material bag is stacked on a pallet.

8. The bag clamping device as claimed in claim 1, wherein the material filling device includes a C-shaped clasp for clasping the filling tube portion of the at least one material bag.

9. The bag clamping device as claimed in claim 1, wherein the material filling device is connected with a gas pipe.

10. The bag clamping device as claimed in claim 1, wherein the sealing device is a heat sealer for sealing the filling tube portion of the at least one material bag.

* * * * *